US011556083B2

(12) United States Patent
Maeda

(10) Patent No.: US 11,556,083 B2
(45) Date of Patent: Jan. 17, 2023

(54) FIXING DEVICE INCLUDING SUPPORTING MEMBER SUPPORTING NIP FORMING MEMBER FROM SIDE OPPOSITE TO FIXING BELT AND IMAGE FORMING DEVICE INCLUDING THE FIXING DEVICE

(71) Applicant: SHARP KABUSHIKI KAISHA, Sakai (JP)

(72) Inventor: Tomohiro Maeda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/379,155

(22) Filed: Jul. 19, 2021

(65) Prior Publication Data

US 2022/0066365 A1 Mar. 3, 2022

(30) Foreign Application Priority Data

Aug. 27, 2020 (JP) ..... JP2020-143846

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
USPC ..... 399/329
See application file for complete search history.

(56) References Cited

U.S. PATENT DOCUMENTS

2007/0189818 A1 8/2007 Kondo et al.

FOREIGN PATENT DOCUMENTS

| | | | | |
|---|---|---|---|---|
| CN | 105319918 A * | 2/2016 | ..... | G03G 15/2053 |
| JP | H09-197880 A | 7/1997 | | |
| JP | 2007-233011 A | 9/2007 | | |
| WO | WO-2020179444 A1 * | 9/2020 | ..... | G03G 15/2053 |

* cited by examiner

*Primary Examiner* — Quana Grainger
(74) *Attorney, Agent, or Firm* — ScienBiziP, P.C.

(57) ABSTRACT

A fixing device includes an endless fixing belt capable of rotational movement, a pressure member that presses from the outside of the fixing belt, a nip forming member arranged on the inner circumference surface side of the fixing belt and forms a fixing nip region between the fixing belt and the pressure member, and a support member supporting the nip forming member from the side opposite to the fixing belt. The support member includes a first support portion and a second support portion. The first support portion supports the nip forming member. The second support portion stands from the surface of the first support portion opposite to the nip forming member so that the center portion in the conveying direction of the recording medium is located at the downstream side of the center portion of the fixing nip region in the conveying direction and within the fixing nip region.

12 Claims, 17 Drawing Sheets

FIXING DEVICE INCLUDING SUPPORTING MEMBER SUPPORTING NIP FORMING MEMBER FROM SIDE OPPOSITE TO FIXING BELT AND IMAGE FORMING DEVICE INCLUDING THE FIXING DEVICE

BACKGROUND OF THE INVENTION

Field of the Invention

The present invention relates to a fixing device and an image forming device including the fixing device such as a copying machine, a multifunction machine, a facsimile machine, and a printer.

Description of the Background Art

As the fixing device, there has been known a fixing device which presses a pressure member (for example. a pressure roller) from the outside to the inside of an endless fixing belt capable of rotational movement, forms a fixing nip region between the fixing belt and the pressure roller by a nip forming member disposed on the inner circumference surface side of the fixing belt, and supports the nip forming member by a support member from the side opposite to the fixing nip region (see, for example, Japanese Unexamined Patent Publication No. Hei 9-197880).

In the fixing device, the support member (reinforcing member in Japanese Patent Application Laid-Open No. Hei 9-197880, and backup member in Japanese Patent Application Laid-Open No. 2007-233011) for supporting a nip forming member (fixing pad in Japanese Patent Application Laid-Open No. Hei 9-197880 support member in Japanese Patent Application Laid-Open No. 2007-233011) includes a first support portion that supports the nip forming member, and a second support portion that is vertically provided from the surface of the first support portion opposite to the nip forming member so that the center in a conveying direction of a recording member such as recording paper is positioned at the center of the fixing nip region in the conveying direction.

In the fixing nip region, the region corresponding to the second support portion of the first support portion supported by the second support portion is a region where the largest pressure is applied when the nip forming member forms the fixing nip region with the pressure roller.

With this regard, in the conventional configurations described in Japanese Patent Application Laid-Open Nos. Hei 9-197880 and 2007-233011, the center portion of the second support portion in the conveying direction of the recording medium is located at the center portion of the fixing nip region in the conveying direction, and the largest pressure is applied at this portion. Therefore, in the fixing nip region, the pressure at the downstream side of the center portion in the conveying direction is smaller than that at the center portion in the conveying direction. Therefore, when the recording medium (recording medium on which the unfixed toner is placed) conveyed to the fixing device is fixed in the fixing nip region and then comes out of the fixing nip region, since the pressure is largest at the center portion of the fixing nip region and smaller at the downstream side, the recording medium is likely to be attracted to the fixing belt side by the fixed toner, so that the peelability of the recording medium from the fixing belt is likely to be deteriorated. Therefore, the toner on the recording medium is disturbed by the fixing belt due to the long contact with the fixing belt, and image defects such as image misalignment occur.

Accordingly, it is desirable to allow the recording medium to move away from the fixing belt as soon as the recording medium comes out of the fixing nip region.

Description of the Background Art

Accordingly, it is an object of the present invention to provide a fixing device and an image forming device capable of improving the peelability of a recording medium from a fixing belt, and thereby effectively preventing the occurrence of image defects such as image misalignment.

SUMMARY OF THE INVENTION

The present inventor has diligently studied to solve the above problems, and found the following. That is, the inventor has been found that, in a fixing device for pressing a pressure roller from the outside to the inside of an endless fixing belt capable of rotational movement, forming a fixing nip region between the fixing belt and the pressure roller by a nip forming member disposed on the inner circumference surface side of the fixing belt, and supporting the nip forming member from the opposite side to the fixing belt by a support member, it is desirable to use a support member, which includes a first support portion that supports the nip forming member, and a second support portion that stands from the surface of the first support portion opposite to the nip forming member so that the center portion in the conveying direction of a recording medium is located at the downstream side of the center portion of the fixing nip region in the conveying direction and is located in the fixing nip region. In this way, the center portion of the second support portion in the conveying direction of the recording medium is located at the downstream side of the center portion of the fixing nip region in the conveying direction and is located in the fixing nip region, and the largest pressure is applied to the portion. Therefore, the portion where the largest pressure is applied in the fixing nip region can be brought to the end portion side (the exit of the recording medium) on the downstream side or can be positioned at the end portion on the downstream side (the exit of the recording medium), and the area where the pressure becomes smaller on the downstream side than the center portion in the conveying direction can be reduced or eliminated. Therefore, when the recording medium (recording medium on which the unfixed toner is placed) conveyed to the fixing device is fixed in the fixing nip region and subsequently comes out of the fixing nip region, because the pressure is the largest on the downstream side of the center portion of the fixing nip region, the recording medium can be less likely to be attracted to the fixing belt side by the fixed toner, and for example, can be easily separated from the fixing belt. Accordingly, it is possible to improve the peelability of the recording medium from the fixing belt.

The present invention is based on such findings. A fixing device according to the present invention includes an endless fixing belt capable of rotational movement, a pressure roller that presses from the outside of the fixing belt, a nip forming member that is arranged on an inner circumference surface side of the fixing belt and forms a fixing nip region between the fixing belt and the pressure roller, and a support member that supports the nip forming member from the side opposite to the fixing belt. The support member includes a first support portion that supports the nip forming member, and a second support portion that is provided so as to stand from a surface of the first support portion opposite to the nip forming member so that a center portion thereof in the conveying direction of the recording medium is located at a downstream side of the center portion of the fixing nip region in the conveying direction and is located in the fixing nip region. Further, an image forming device according to the present invention includes the fixing device according to the present invention.

According to the present invention, it is possible to improve the peelability of the recording medium from the fixing belt, and thereby it is possible to effectively prevent the occurrence of image defects such as image misalignment.

DESCRIPTION OF THE PREFERRED EMBODIMENTS

Figure 1:
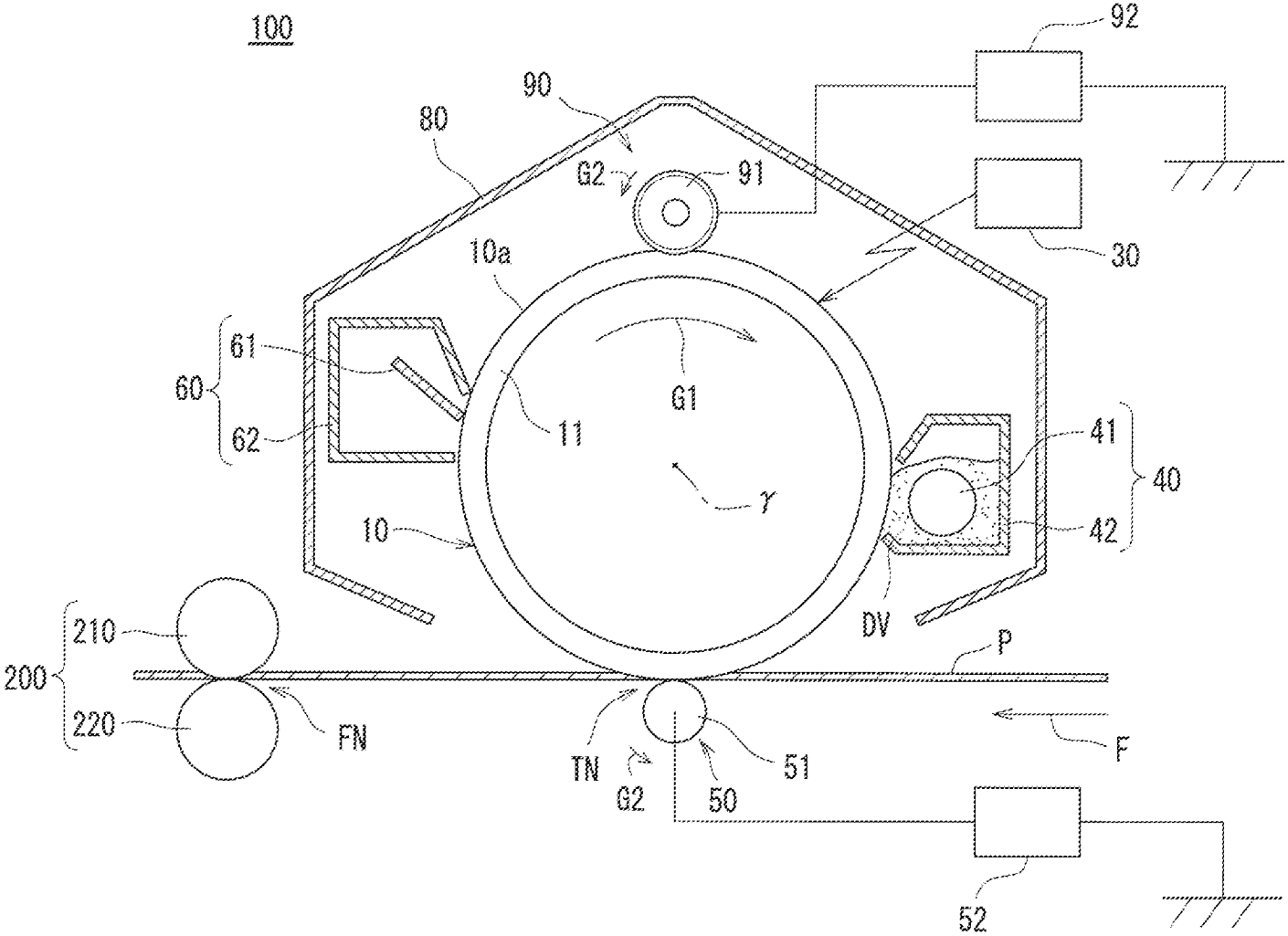
FIG. 1 is a cross-sectional view schematically showing an overview configuration of an image forming device including a fixing device according to an embodiment of the present invention.

Hereafter, embodiments according to the present invention will be described with reference to the drawings. In the following description, the same components are designated by the same reference numerals. Their names and functions are the same. Therefore, the detailed description thereof will not be repeated.

Image Forming Device

FIG. 1 is a cross-sectional view schematically showing a schematic configuration of an image forming device 100 including a fixing device 200 according to an embodiment of the present invention.

As shown in FIG. 1, the image forming device 100 includes a photosensitive drum 10 serving as an image carrier, a charging device 90, an exposure device 30, a developing device 40, a transfer device 50, a cleaning device 60, and the fixing device 200. The charging device 90 charges a surface 10*a* of the photosensitive drum 10. The exposure device 30 exposes the photosensitive drum 10 charged by the charging device 90 to form an electrostatic latent image. The developing device 40 develops the electrostatic latent image formed by the exposure device 30 to form a toner image. The transfer device 50 transfers the toner image formed by the developing device 40 onto a recording medium P such as recording paper. The cleaning device 60 removes and recovers the toner remaining on the photosensitive drum 10. The fixing device 200 fixes the toner image transferred by the transfer device 50 onto the recording medium P conveyed in the conveying direction F to form an image. In this example, the image forming device 100 is a monochrome printer (specifically, a laser printer). Note that the image forming device 100 may be, for example, an intermediate transfer type color image forming device capable of forming a color image. Also, although the image forming device 100 is a printer in this example, it may be, for example, a copying machine, a multifunction machine, or a facsimile machine.

In the photosensitive drum 10, a base 11 is rotatably supported by a main frame (not shown) of the image forming device 100, and is rotationally driven in a predetermined first rotation direction G1 (clockwise in the drawing) around a rotation axis γ by a driver which is omitted in the drawing.

The charging device 90 includes a charging member 91. The charging member 91 evenly charges the surface 10*a* of the photosensitive drum 10 to a uniform predetermined potential by a high voltage applying device 92. The charging member 91 is a charging roller in this example, and is driven to rotate in a second rotation direction G2 with respect to the rotation of the photosensitive drum 10. Note that the charging member 91 may be an electrostatic charging charger.

The exposure device 30 repeatedly scans the surface 10*a* of the photosensitive drum 10, which is rotationally driven, with the light modulated based on image information in the direction of the rotation axis γ of the photosensitive drum 10, which is the main scanning direction. The developing device 40 includes a developing roller 41 and a developing tank 42. The developing roller 41 supplies a developer DV to the surface 10*a* of the photosensitive drum 10. The developing tank 42 contains the developer DV. The transfer device 50 includes a transfer member 51. The transfer device 50 applies a predetermined high voltage to a transfer nip region TN formed between the photosensitive drum 10 and the transfer device 50 by a high voltage applying device 52. The transfer member 51 is a transfer roller in this example, and is driven to rotate in the second rotation direction G2 with respect to the rotation of the photosensitive drum 10. Note that the transfer member 51 may be a transfer charger.

The cleaning device 60 includes a cleaning blade 61 and a recovery casing 62. The cleaning blade 61 removes the toner remaining on the surface 10*a* of the photosensitive drum 10. The recovery casing 62 accommodates the toner removed by the cleaning blade 61. The fixing device 200 includes a heat fixer 210 (heat fixing unit) and a pressure roller 220 (an example of a pressure member). The pressure roller 220 forms a fixing nip region FN together with the heat fixer 210. The detailed configuration of the fixing device 200 will be described below. Further, the image forming device 100 includes a housing 80 for accommodating each component constituting the image forming device 100.

Fixing Device

Figure 2A:
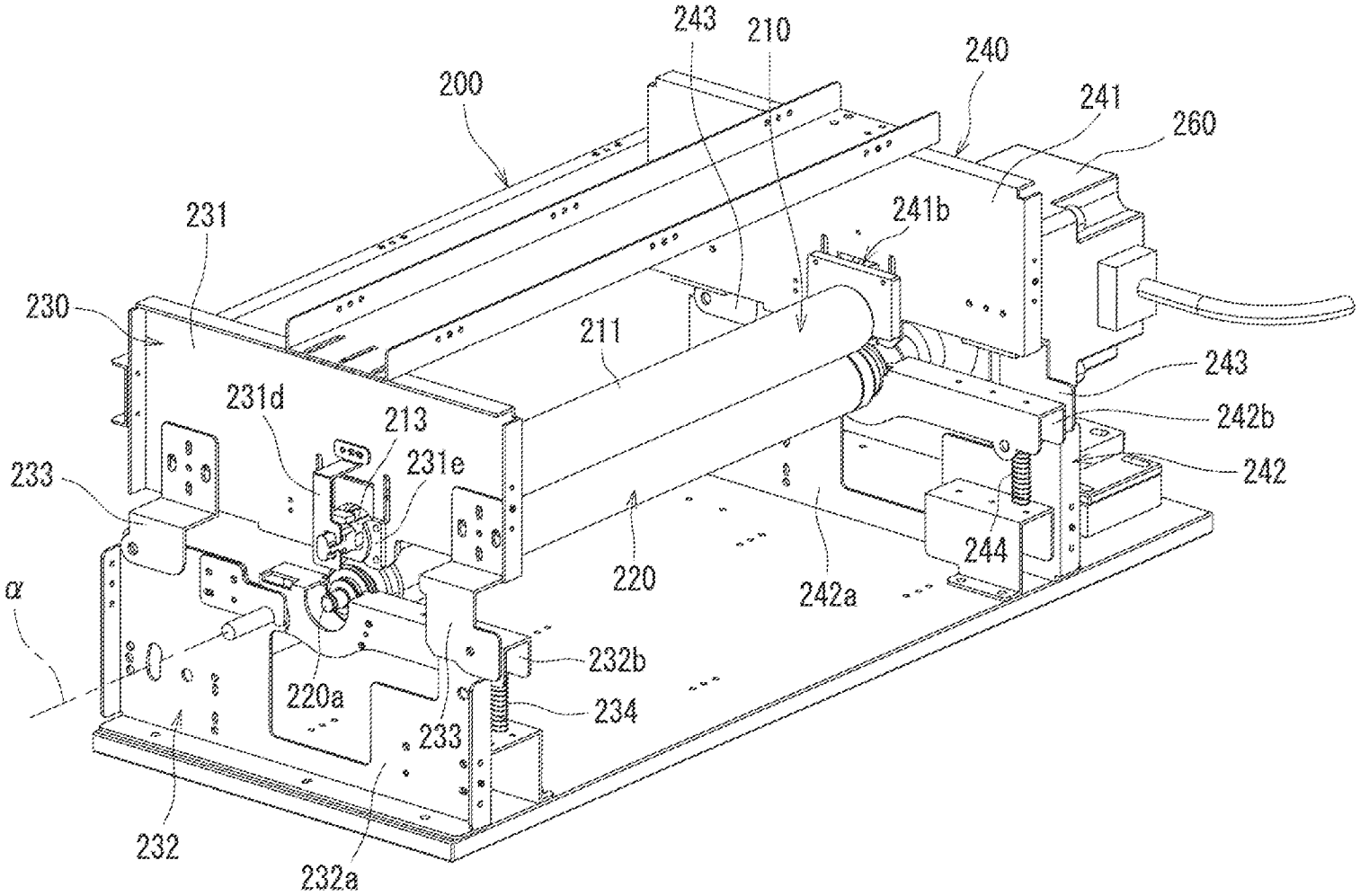
FIG. 2A is a perspective view of the fixing device in the image forming device shown in FIG. 1 as viewed from diagonally above the front side.
Figure 2B:
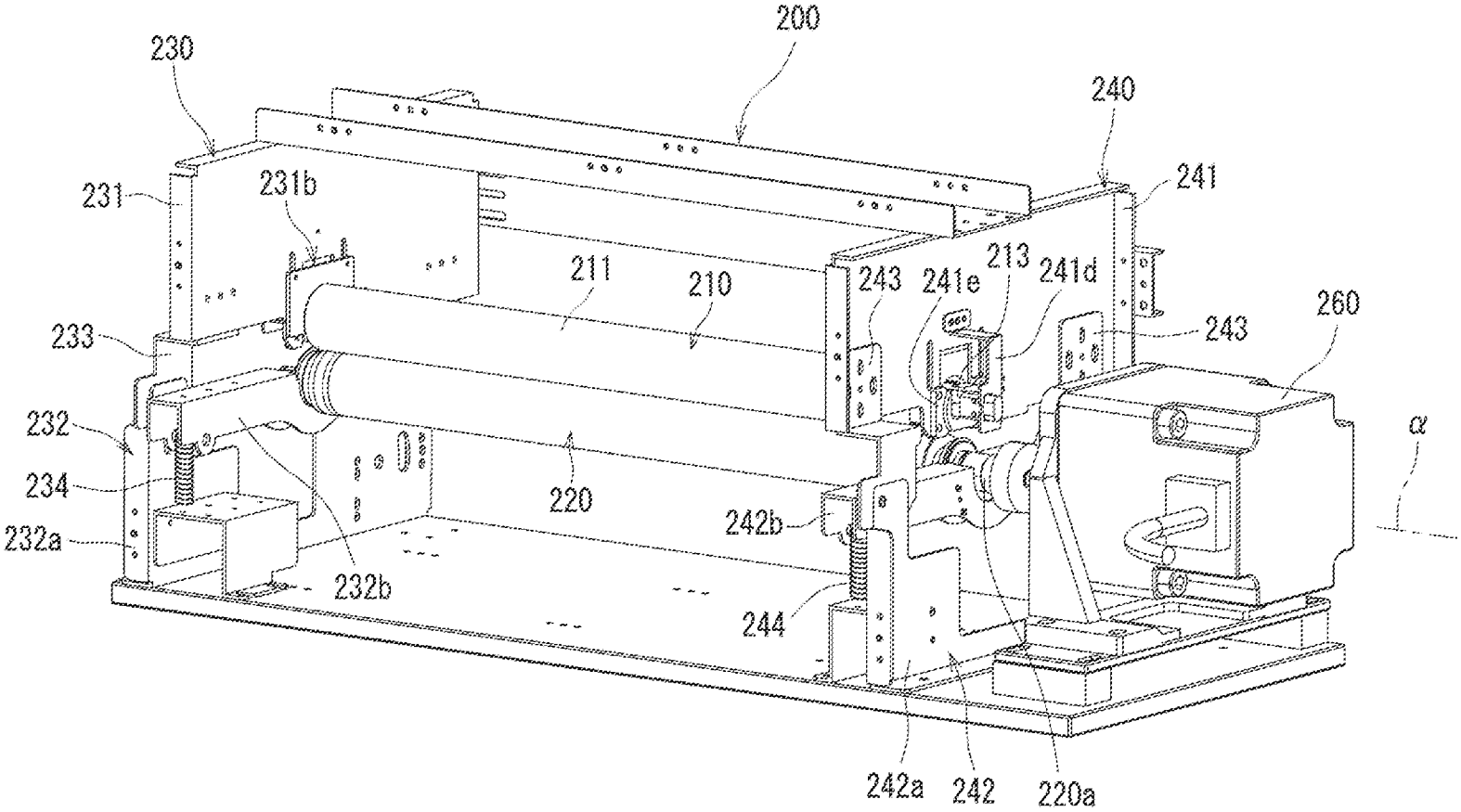
FIG. 2B is a perspective view of the fixing device in the image forming device shown in FIG. 1 as viewed from diagonally above the rear side.
Figure 3:
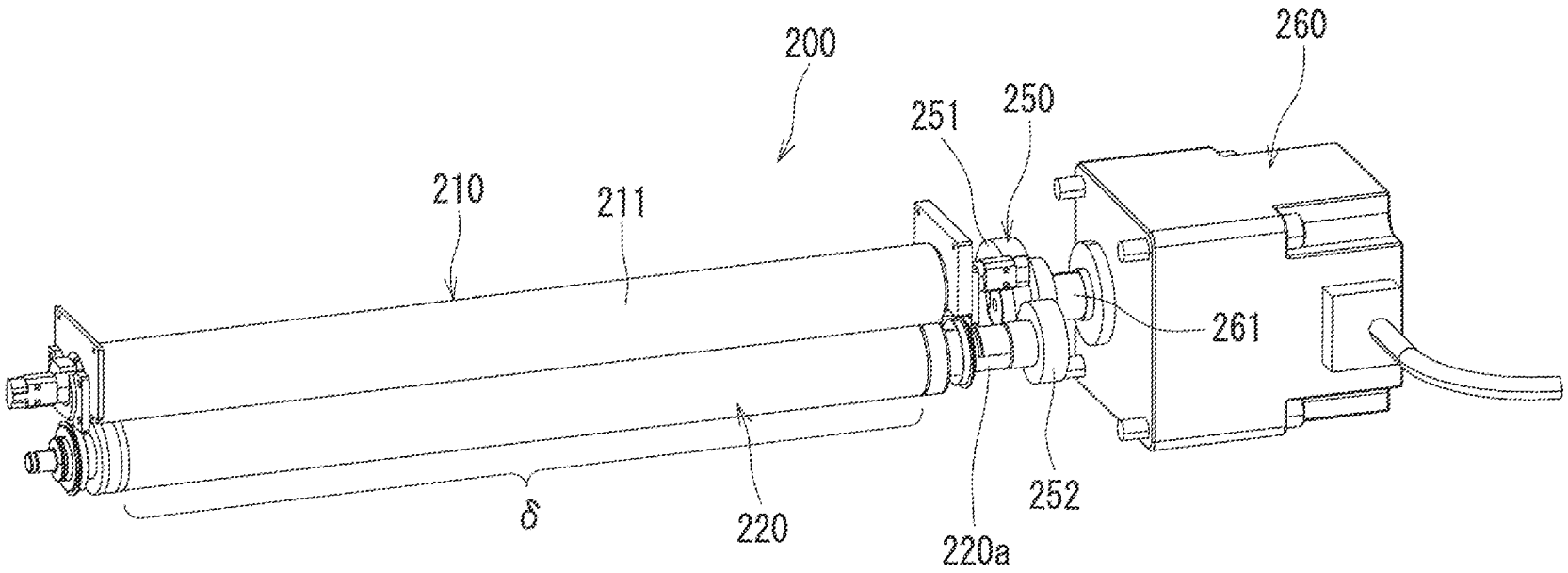
FIG. 3 is a perspective view showing a drive system to a pressure roller in the fixing device shown in FIGS. 2A and 2B as viewed from above on the right side.
Figure 4A:
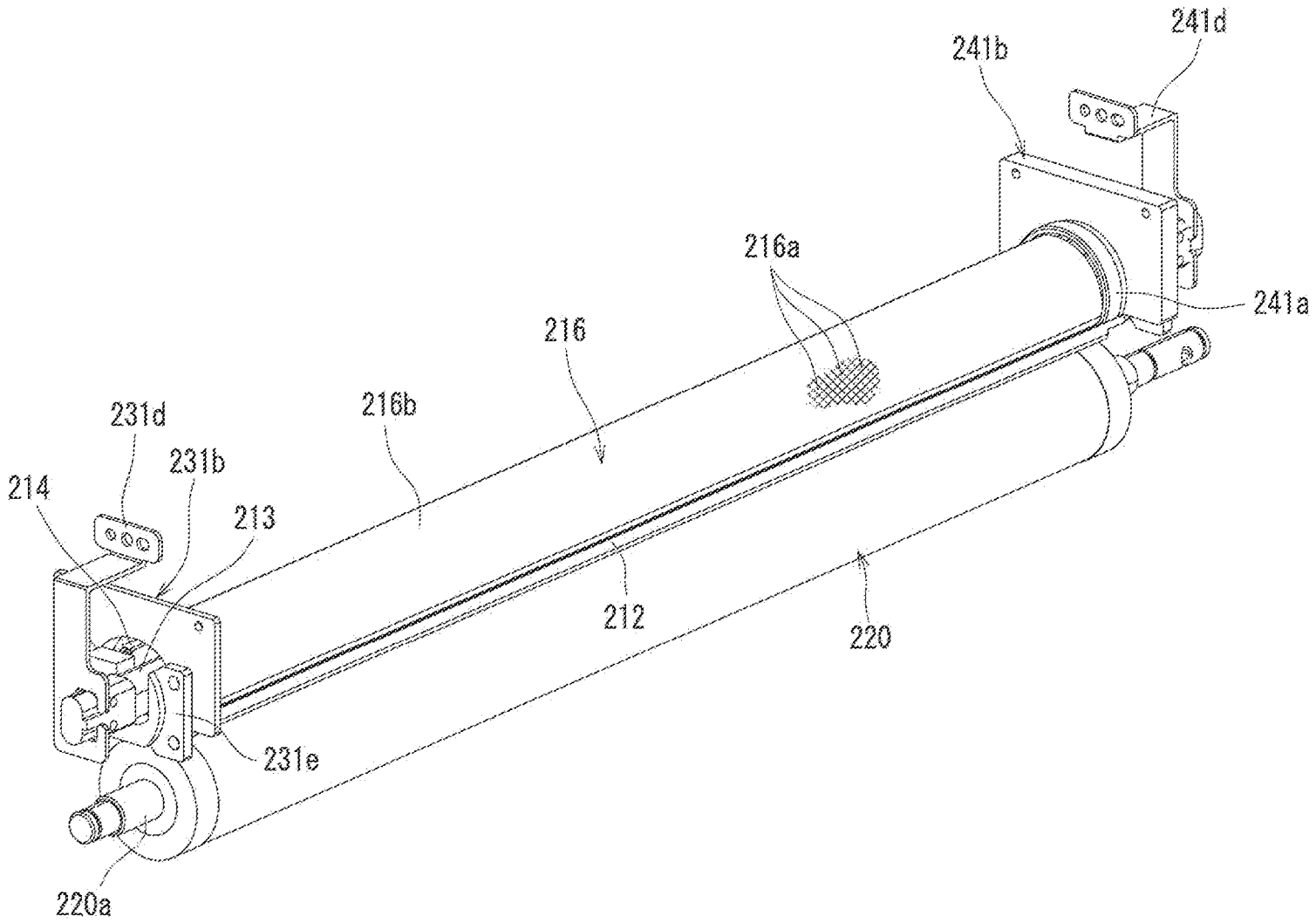
FIG. 4A is a perspective view of a portion of a heat fixer and a pressure roller in a state where a fixing belt is removed in the fixing device shown in FIGS. 2A and 2B, as viewed from diagonally above the front side.
Figure 4B:
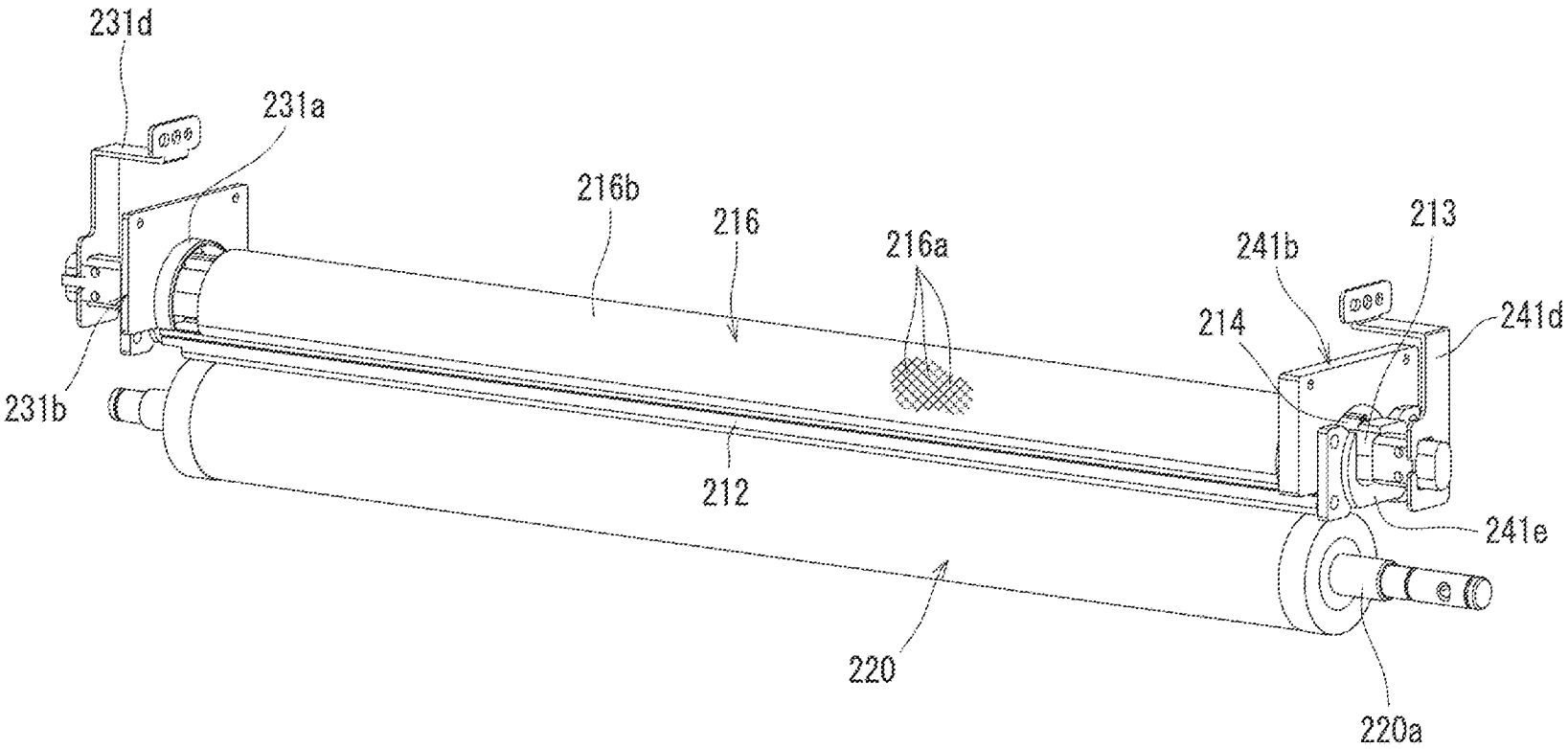
FIG. 4B is a perspective view of a portion of the heat fixer and the pressure roller in a state in which the fixing belt is removed in the fixing device shown in FIGS. 2A and 2B, as viewed from diagonally above the rear side.
Figure 5:
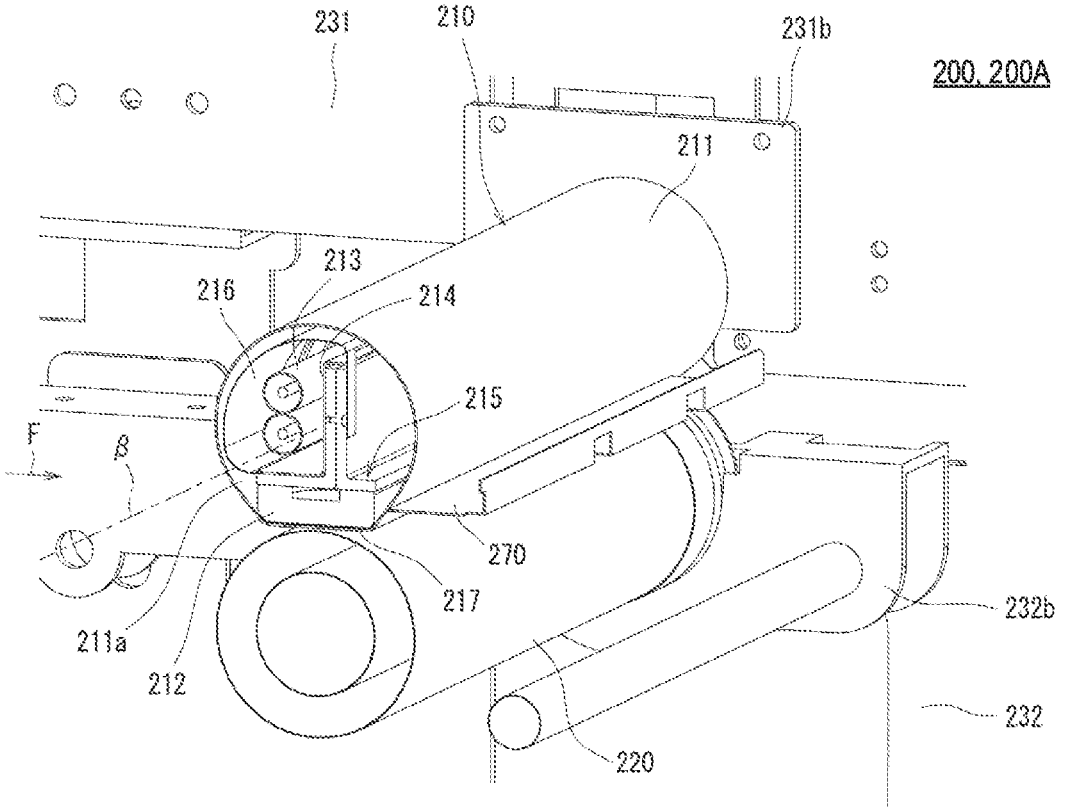
FIG. 5 is a perspective view showing a cross-sectional structure of a portion of a heat fixer and a pressure roller in the fixing device according to the first embodiment as viewed from the rear side.
Figure 6A:
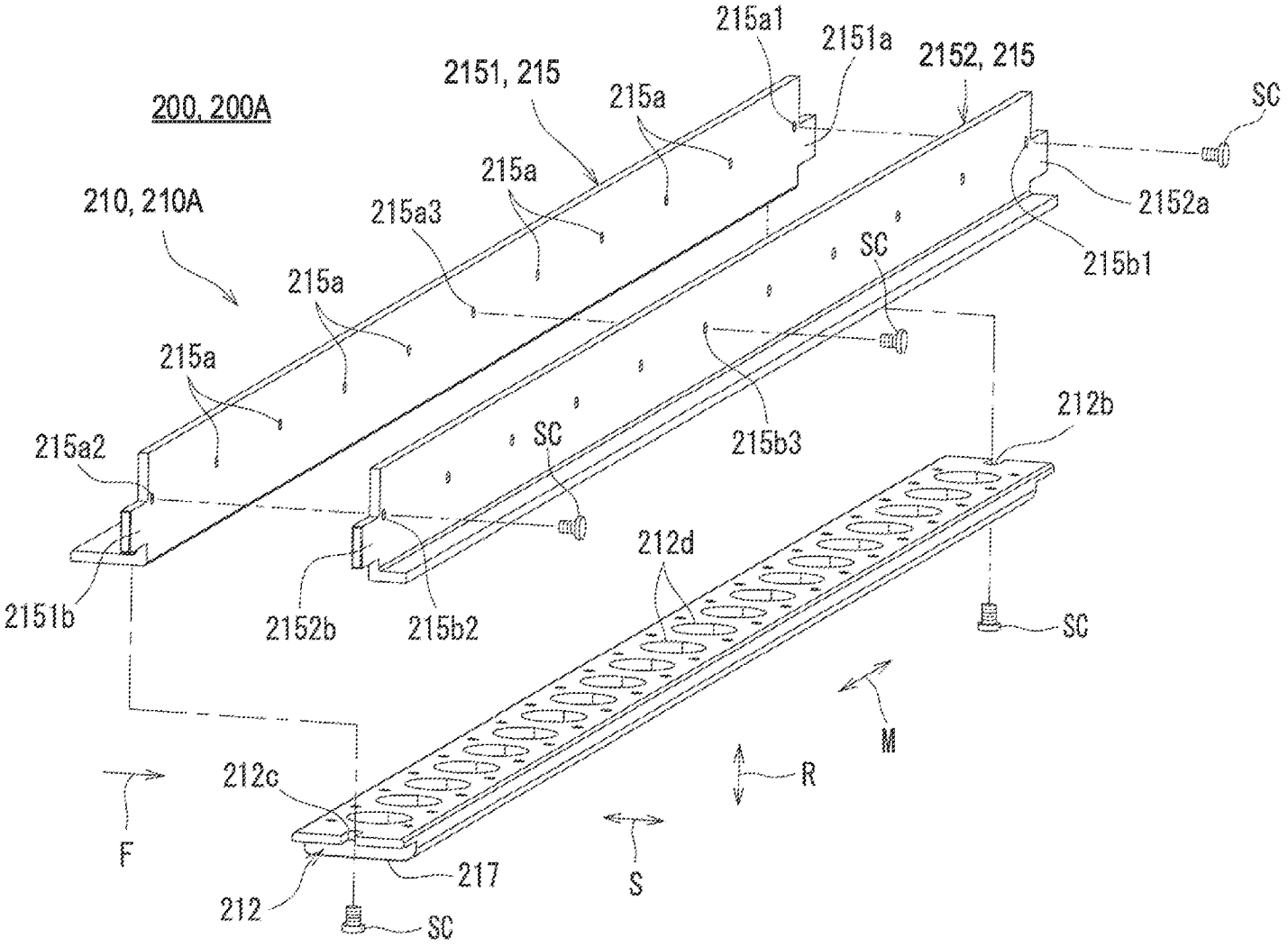
FIG. 6A is a perspective view of a nip forming member and two support members in a support member in the fixing device according to the first embodiment as viewed from the upper right of the rear side.
Figure 6B:
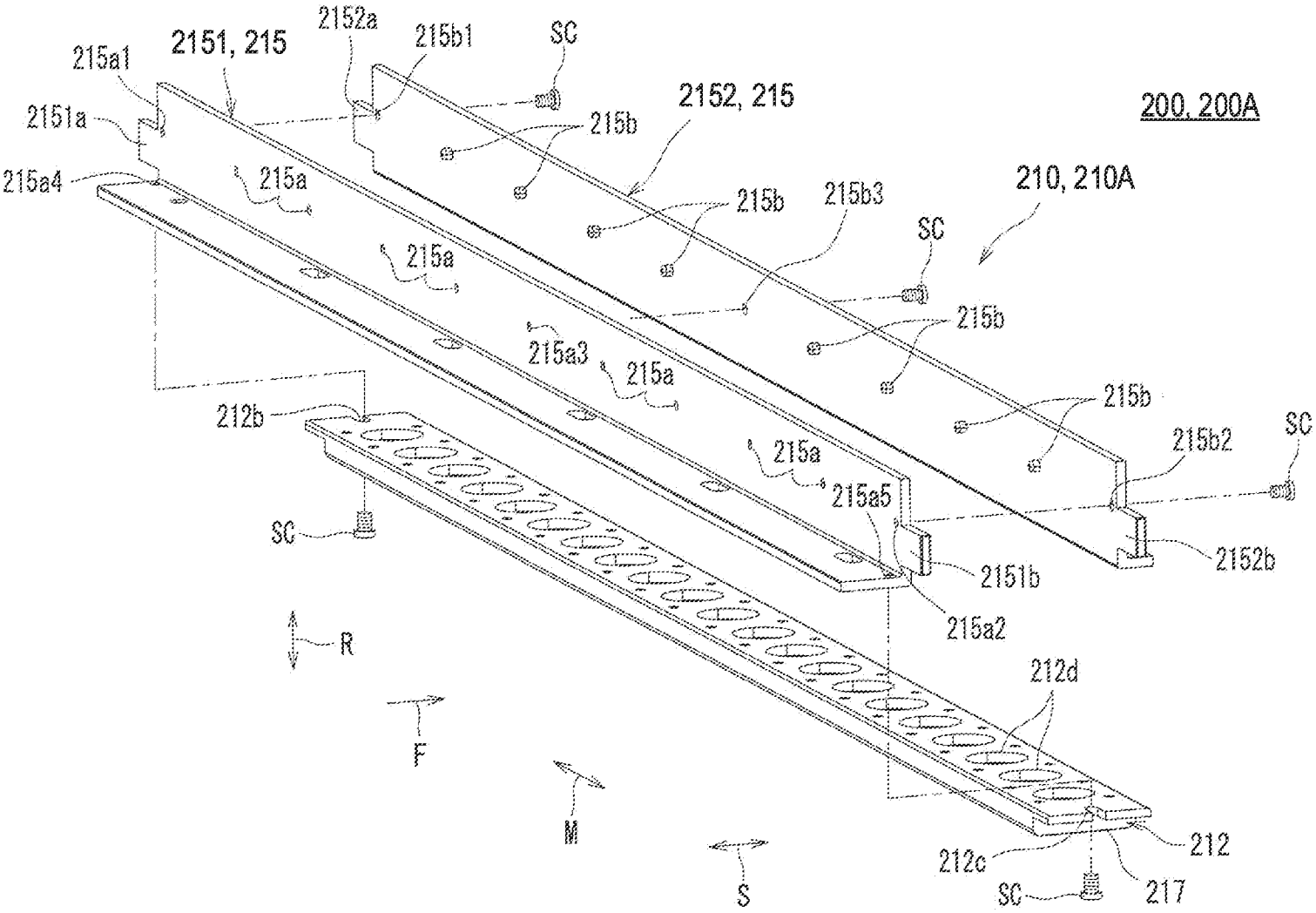
FIG. 6B is a perspective view of the nip forming member and the two support members in the support member in the fixing device according to the first embodiment as viewed from the upper left on the rear side.
Figure 7A:
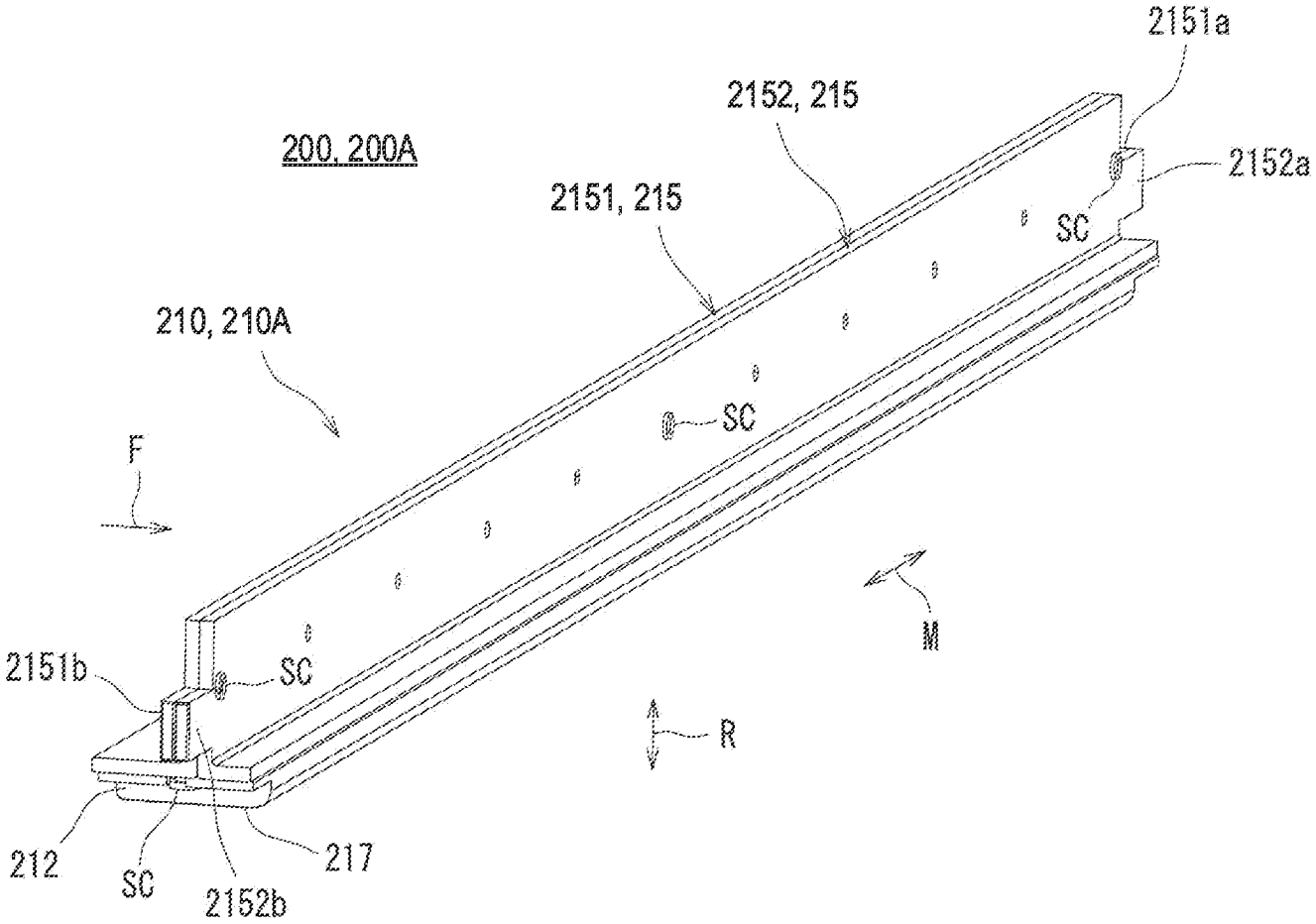
FIG. 7A is a perspective view of the fixing device according to the first embodiment, in which the two support members in the support member are attached to the nip forming member as viewed from the upper right on the rear side.
Figure 7B:
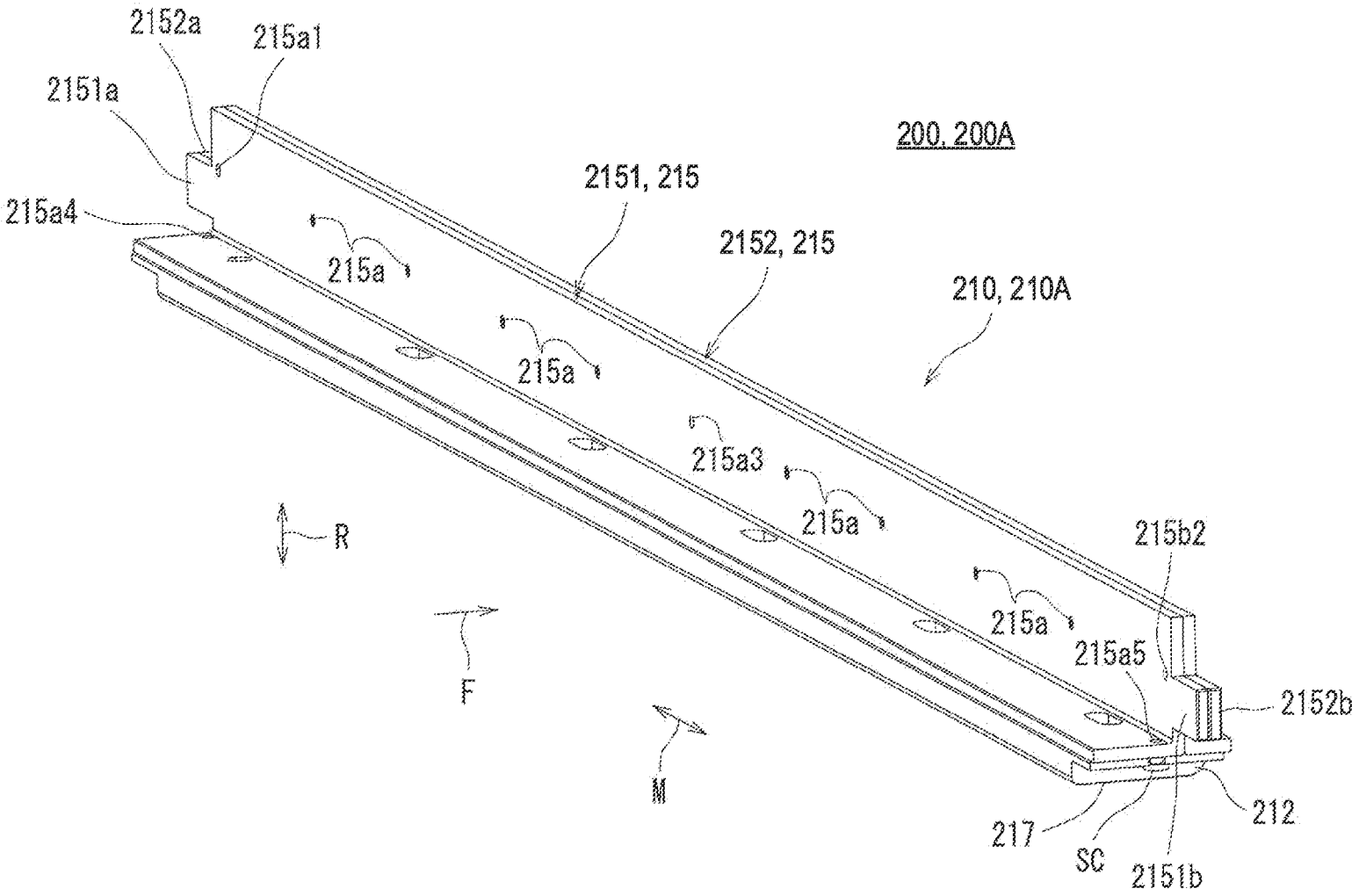
FIG. 7B is a perspective view of the fixing device according to the first embodiment, in which the two support members in the support member are attached to the nip forming member, as viewed from the upper left of the rear side.
Figure 8A:
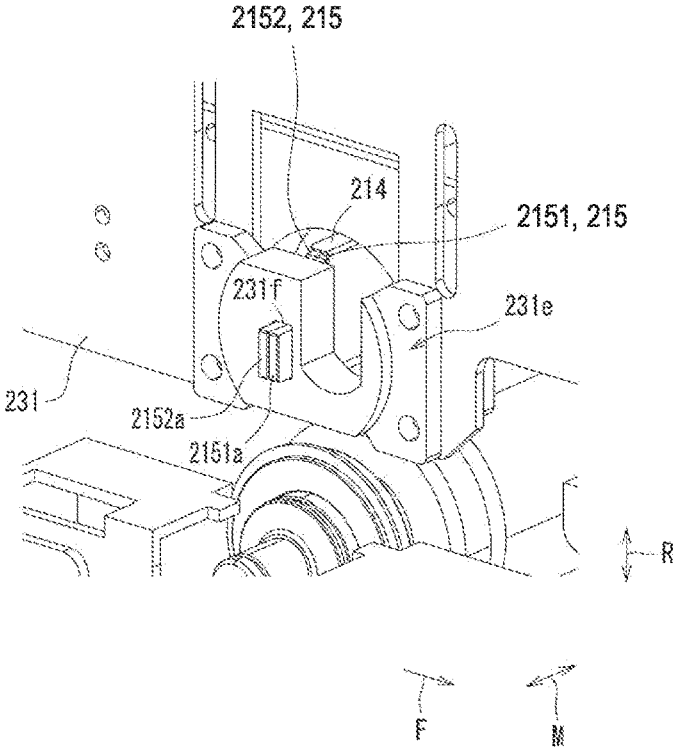
FIG. 8A is a perspective view showing a state in which a heater and a front lamp support portion are removed and the two support members are attached to a front upper frame.
Figure 8B:
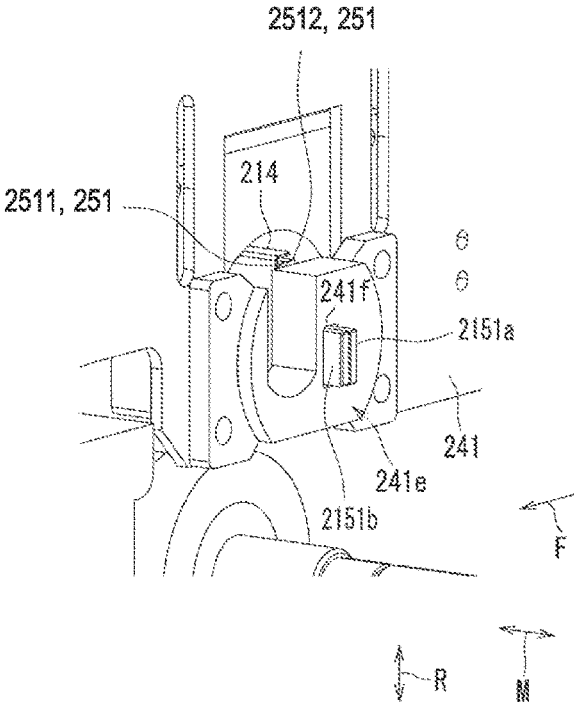
FIG. 8B is a perspective view showing a state in which the heater and a rear lamp support portion are removed and the two support members are attached to a rear upper frame.
Figure 9:
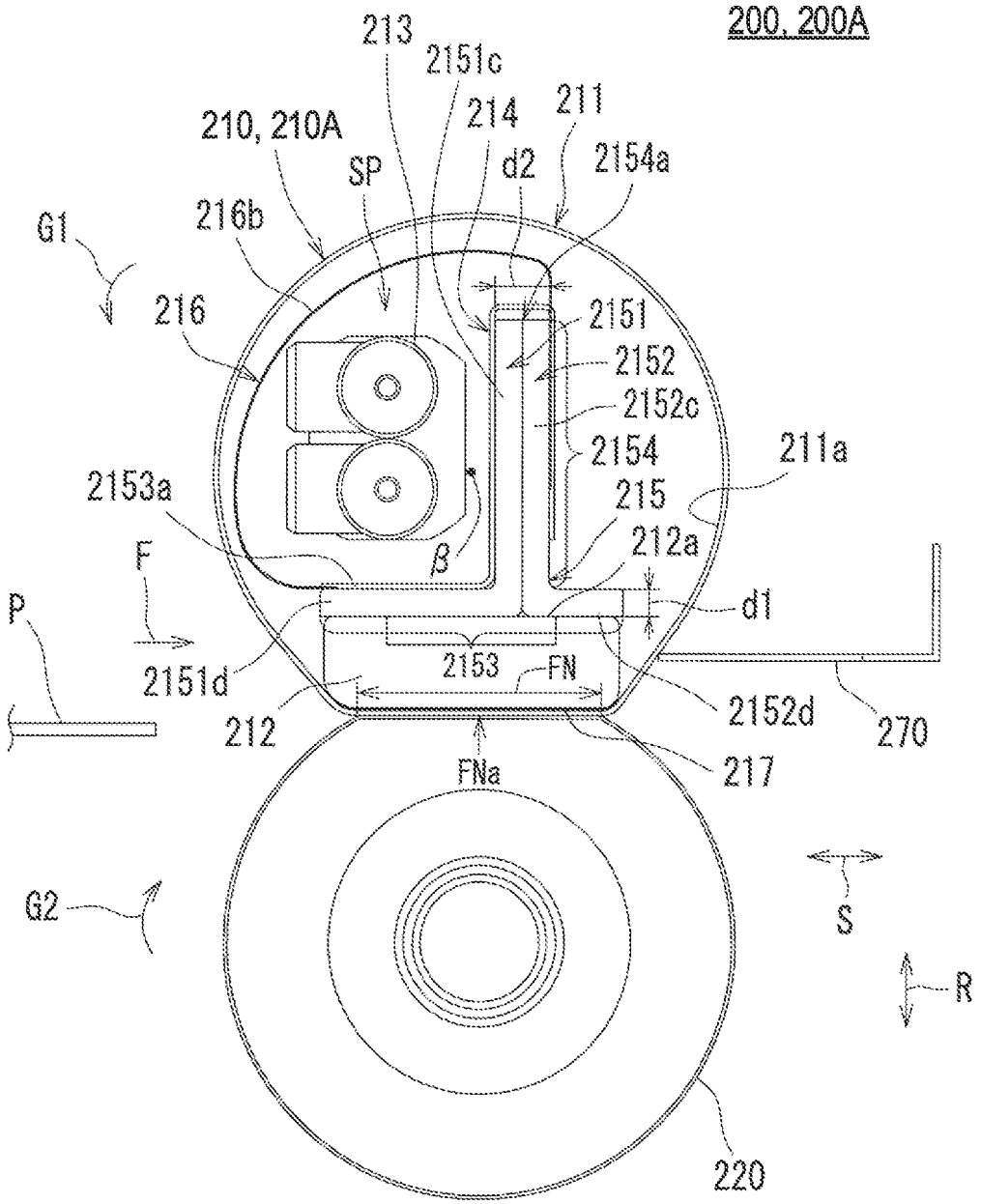
FIG. 9 is a cross-sectional view of a portion of the heat fixer and the pressure roller in the fixing device according to the first embodiment as viewed from the rear side.

FIGS. 2A and 2B are perspective views of the fixing device 200 in the image forming device 100 shown in FIG. 1, as viewed from diagonally above the front side and diagonally above the rear side, respectively. FIG. 3 is a right side view showing a drive system to the pressure roller 220 in the fixing device 200 shown in FIGS. 2A and 2B. FIGS. 4A and 4B are perspective views of a portion of the heat fixer 210 and the pressure roller 220 in a state in which a fixing belt 211 is removed in the fixing device 200 shown in FIGS. 2A and 2B, as viewed from diagonally above the front side and diagonally above the rear side, respectively. FIG. 5 is a perspective view showing a cross-sectional structure of a portion of the heat fixer 210 and the pressure roller 220 in the fixing device 200 (200A) according to the first embodiment as viewed from the rear side. FIGS. 6A and 6B are perspective views of a nip forming member 212 and two support members 2151 and 2152 in a support member 215 in the fixing device 200 (200A), according to the first embodiment, as viewed from the upper right on the rear side and the upper left on the rear side, respectively. FIGS. 7A and 7B are perspective views of the state in which the two support members 2151 and 1522 of the support member 215 are attached to the nip forming member 212, respectively, as viewed from the upper right on the rear side and the upper left on the rear side, in the fixing device 200 (200A) according to the first embodiment. FIGS. 8A and 8B are perspective views showing states in which a heater 213, a front lamp support portion 231*d*, and a rear lamp support portion 241*d* are removed, and the two support members 2151 and 2152 are attached to a front upper frame 231 and a rear upper frame 241, respectively. Further, FIG. 9 is a cross-sectional view of a portion of the heat fixer 210 (210A) and the pressure roller 220 in the fixing device 200 (200A) according to the first embodiment as viewed from the rear side.

As shown in FIGS. 2A and 2B, the fixing device 200 includes the heat fixer 210, a pressure roller 220, a front frame 230 (side plate), a rear frame 240 (side plate), and a peeling member 270. The front frame 230 includes a front upper frame 231, a front lower frame 232, and connecting portions 233. The front upper frame 231 and the front lower frame 232 are vertically connected by the connecting portions 233. The rear frame 240 includes a rear upper frame 241, a rear lower frame 242, and connecting portions 243. The rear upper frame 241 and the rear lower frame 242 are vertically connected by the connecting portions 243.

The heat fixer 210 includes the fixing belt 211, a nip forming member 212, a heater 213, a reflection member 214, a support member 215, a protection member 216, and a slide sheet 217.

The fixing belt 211 is an endless (tubular) heat-resistant belt (film) capable of rotational movement. The pressure roller 220 presses from the outside of the fixing belt 211. The nip forming member 212 is disposed on an inner circumference surface 211*a* side of the fixing belt 211 to form the fixing nip region FN between the fixing belt 211 and the pressure roller 220. The nip forming member 212 is also a contact member that contacts the inner circumference surface 211*a* of the fixing belt 211. The heater 213 heats the fixing belt 211 from inside. The reflection member 214 reflects the light (particularly infrared light) emitted from the heater 213 toward the fixing belt 211. The support member 215 supports the nip forming member 212 from the side opposite to the fixing nip region FN. The slide sheet 217 is provided between the fixing belt 211 and the nip forming member 212.

The front upper frame 231 and the rear upper frame 241 support the front end portion and the rear end portion of the fixing belt 211, respectively, so that the fixing belt 211 is capable of rotational movement. The front upper frame 231 and the rear upper frame 241 are respectively provided with a front support member 231*b* having a half-ring-shaped sliding contact portion 231*a* and a rear support member 241*b* having a half-ring-shaped sliding contact portion 241*a*. Therefore, the sliding contact portions 231*a* and 241*a* do not rotate. Each of the sliding contact portions 231*a* and 241*a* is provided so that the sliding contact surface faces the opposite side of the fixing nip region FN. The inside of both ends of the fixing belt 211 is slidably supported by the outside of the sliding contact portions 231*a* and 241*a* in the rotational axis ß (see FIGS. 5 and 9). Thus, the fixing belt 211 is capable of rotational movement while the inner circumference surface 211*a* is in sliding contact with the sliding contact surface of the sliding contact portions 231*a* and 241*a*.

The fixing belt 211 may be a member in which a silicone rubber layer having a predetermined thickness (for example, about 100 μm to about 300 μm) is formed on a metal or polyimide (PI) substrate having a predetermined thickness (for example, about 30 μm to about 100 μm), and a fluororesin having a thickness (for example, about 20 μm to about 30 μm) is further formed on the silicone rubber layer, as an example. More specifically, the fixing belt 211 may be a member in which a PFA tube is provided or a fluororesin is coated on the silicone rubber layer.

The nip forming member 212 may be a member formed of a heat-resistant material having rigidity, such as liquid crystal polymer (LCP) resin and polyetheretherketone (PEEK) resin, or polyphenylene sulfide (PPS), as an example. In the case where the rigid nip forming member 212 is made to have elasticity, an elastic layer (for example, a rubber layer such as silicone rubber) can be provided on the surface thereof. In this example, the nip forming member 212 is made of a liquid crystal polymer having a thickness of 4.5 mm and a width of 15 mm in the short direction S orthogonal to the axial direction M which is the direction of the rotational axis ß of the fixing belt 211.

The slide sheet 217 may be a member (for example, a glass cloth sheet) obtained by applying a fluororesin such as polytetrafluoroethylene (PTFE) to a glass fiber material (for example, a glass cloth), as an example. The thickness of the slide sheet 217 is not limited thereto, but a sheet having a thickness of about 0.1 mm to 0.5 mm can be used, for example. In this example, the thickness of the slide sheet 217 is 0.13 mm. The slide sheet 217 and the nip forming member 212 are adhered to each other by an adhesive or an adhesive member.

The heater 213 includes a heater lamp. As shown in FIGS. 2A and 2B, the front end portion and the rear end portion of the heater 213 are fixed to the front upper frame 231 and the rear upper frame 241 via a front lamp support portion 231*d* and a rear lamp support portion 241*d*, respectively. The heater 213 raises the temperature up to, for example, close to 800° C.

The reflection member 214 is a plate-like member in this example, and is provided at least along the surface of the support member 215 facing the heater 213. The reflection member 214 is formed of a metal material such as aluminum. The surface of the reflection member 214 is mirror-finished. Thus, the fixing belt 211 can be efficiently irradiated with the light emitted from the heater 213. The reflection member 214 is fixed to the support member 215. The reflection member 214 is a plate (reflection plate) bent along the support member 215 so as to face at least the heater 213.

As shown in FIGS. 6A and 6B, the support member 215 includes two support members 2151 and 2152. One support member 2151 of the two support members 2151 and 2152 is provided with a concave portion 215*a*, and the other support member 2152 is provided with a convex portion 215*b* which engages with the concave portion 215*a*. As a result, since the concave portion 215*a* and the convex portion 215*b* are engaged with each other, the two support members 2151 and 2152 can be reliably connected to each other, thereby improving the supportability to the nip forming member 212.

In the present embodiment, the concave portion 215*a* is a hole through which the convex portion 215*b* is inserted. Here, the hole may be a through hole or a bottomed hole. In this way, the hole (concave portion 215*a*) of the support member 2151 and the convex portion 215*b* of the other support member 2152 can be reliably engaged with each other.

The concave portion 215*a* in the support member 2151 may be formed as a recess by, for example, half punch processing or a process of forming a through hole using a metal mold having a punch and a die, that is, so-called punch processing. In this example, the hole (concave portion 215*a*) is a through hole, and is formed by the punch processing. Further, the convex portion 215*b* of the other support member 2152 can be formed, for example, by a process of forming a convex using a metal mold having a punch and a die, that is, so-called half punch processing.

More specifically, the concave portion 215*a* of the support member 2151 and the convex portion 215*b* of the other support member 2152 are provided at a plurality of points (eight points in this example) in the axial direction M.

Fastening portions 215*a*1, 215*a*2 and 215*a*3 (female screw holes in this example) each for fastening a fastening member SC such as a screw are provided at both of the end portions and the center portion of the support member 2151 in the axial direction M. The concave portions 215*a* to 215*a* and the fastening portions 215*a*1 to 215*a*3 are provided equally along the axial direction M in the support member 2151.

Through holes 215*b*1, 215*b*2 and 215*b*3 through which the fastening members SC are inserted are provided at both of the end portions and the center portion of the other support member 2152 in the axial direction M. The convex portions 215*b* to 215*b* and the through holes 215*b*1 to 215*b*3 are provided equally in the axial direction M in the other support member 2152.

The fastening members SC to SC are fastened to the fastening portions 215*a*1 to 215*a*3 while being inserted into the through holes 215*b*1 to 215*b*3. Thus, the two support members 2151 and 2152 can be fixed.

Noted that, the central fastening portion 215*a*3 in the support member 2151 may be the concave portion 215*a*, and the central through hole 215*b*3 in the other support member 2152 may be the convex portion 215*b*. Further, although the concave portion 215*a* is formed in the support member 2151 and the convex portion 215*b* is formed in the other support member 2152 in the present embodiment, the convex portion may be formed in the support member 2151 and the concave portion may be formed in the other support member 2152.

The nip forming member 212 and the support member 215 are fixed by the fastening members SC (see FIGS. 7A and 7B). Insertion portions 212*b* and 212*c* (notches or through holes, in this example, notches) through which the fastening members SC are inserted are provided at both of the end portions of the nip forming member 212 in the axial direction M. Fastening portions 215*a*4 and 215*a*5 (female screw holes in this example) (see FIG. 6B) for screwing with the fastening members SC are provided at both of the end portions of the support member 2151 in the axial direction M. The fastening members SC and SC are fastened to the fastening portions 215*a*4 and 215*a*5 in a state of being inserted through the insertion portions 212*b* and 212*c*. Thus, the support member 215 can support the nip forming member 212 while the nip forming member 212 is fixed (see FIGS. 7A and 7B).

The nip forming member 212 may be warped in the axial direction M. Therefore, the pressing force of the pressure roller 220 becomes uneven against the nip forming member 212 via the fixing belt 211 in the axial direction M.

In this regard, a plurality of bottomed holes 212*d* to 212*d* are provided in parallel along the axial direction M in the nip forming member 212. A spacer, which is not shown, is disposed in at least one of the plurality of bottomed holes 212*d* to 212*d*. As the spacer, spacers having a plurality of types of thicknesses that are larger than the depth of the bottomed hole 212*d* by a predetermined amount are prepared. The pressing force of the pressure roller 220 can be made uniform against the nip forming member 212 in the axial direction M through the fixing belt 211 by arranging a desired spacer at a desired position in the plurality of bottomed holes 212*d* to 212*d* according to the warp position of the nip forming member 212.

As shown in FIGS. 8A and 8B, the front end portions and the rear end portions of the two support members 2151 and 2152 are fixed to the front upper frame 231 and the rear upper frame 241 via a front support portion 231*e* and the rear support portion 241*e*, respectively. The two support members 2151 and 2152 are provided with extension portions (2151*a* and 2151*b*) and (2152*a* and 2152*b*) extending outward from both of the end portions in the axial direction M. The front support portion 231*e* and the rear support portion 241*e* are provided with through holes 231*f* and 241*f* penetrating in the axial direction M, respectively. The two support members 2151 and 2152 are fixed to the front support portion 231*e* and the rear support portion 241*e* in a state where the extension portions (2151*a* and 2151*b*) and (2152*a* and 2152*b*) are inserted into the through holes 231*f* and 241*f*.

The protection member 216 is provided between the heater 213 and the fixing belt 211. The protection member 216 protects the fixing belt 211 from the heater 213.

The protection member 216 is a heat-resistant member configured to allow the light emitted from the heater 213 and/or the light reflected from the reflection member 214 to be applied to the fixing belt 211. Thus, the fixing belt 211 can be efficiently heated when the fixing belt 211 is irradiated with light through the protection member 216.

The protection member 216 is provided with a large number of through holes 216*a* to 216*a* (see FIGS. 4A and 4B).

The protection member 216 may be a member in which a fibrous material is knitted into a mesh shape, a member in which a belt-shaped material is subjected to hole opening processing (punch processing) for providing the large number of through holes 216*a* to 216*a*, or a member in which a belt-shaped material is subjected to etching processing for providing the large number of through holes 216*a* to 216*a*, for example. The fibrous material may, for example, be a metal material such as stainless steel (SUS) or aluminum. The belt-shaped material may, for example, be a metal material such as stainless steel (SUS) or nickel. The thickness of the protection member 216 is preferably small, preferably about 0.5 mm or less.

The protection member 216 is provided so that the surface 216*b* facing the fixing belt 211 faces the upstream side of the fixing nip region FN in the conveying direction F of the recording medium P. The protection member 216 does not rotate like the sliding contact portions 231*a* and 241*a*.

As shown in FIGS. 2A and 2B, the front lower frame 232 and the rear lower frame 242 includes a front lower frame body 232*a* and a rear lower frame body 242*a*, and a front rotating member 232*b* and a rear rotating member 242*b*, respectively. The front rotating member 232*b* and the rear rotating member 242*b* are supported so as to be rotatable about the rotation axis α by a rotary shaft, which is not shown, with respect to the front lower frame body 232*a* and the rear lower frame body 242*a*, respectively. The front rotating member 232*b* and the rear rotating member 242*b* respectively rotatably support the front end portion and the rear end portion of the rotary shaft 220*a* of the pressure roller 220. The front rotating member 232*b* and the rear rotating member 242*b* are respectively urged toward the fixing belt 211 by urging members 234 and 244 (coil springs) so that the pressure roller 220 presses the fixing belt 211. Thus, the pressure roller 220 can press the fixing belt 211.

The pressure roller 220 may be a member in which an elastic member (sponge rubber such as silicone rubber or rubber such as solid rubber) having a predetermined thickness (about 6 mm, for example) and a hardness of about 35 to 40 degrees is provided on a metal base such as aluminum, and a fluororesin is formed on the elastic member, as an example. More specifically, the pressure roller 220 may be a member in which a PFA tube is provided on the elastic member. In this example, the fluororesin is provided in a passage region δ (see FIG. 3) of the recording medium P in the pressure roller 220. That is, the rubber member is exposed in a region other than the passage region δ of the pressure roller 220 (for example, about 10 mm in each end region). This makes it easy for the driving (rotating) force from the pressure roller 220 to be transmitted to both ends of the fixing belt 211 at both ends of the pressure roller 220. As a result, the rotation failure of the fixing belt 211 can be effectively prevented.

As shown in FIG. 3, the pressure roller 220 is rotationally driven by a rotational driving force from a rotary driver 260 (driving motor) via a drive transmission mechanism 250. The drive transmission mechanism 250 includes a drive gear 251 and a driven gear 252. The drive gear 251 is fixed to a rotary shaft 261 of the rotary driver 260. The driven gear 252 is fixed to the rotary shaft 220*a* of the pressure roller 220 in a state of being meshed with the drive gear 251. Thus, the rotary driver 260 can rotationally drive the pressure roller 220 in the second rotation direction G2 via the drive transmission mechanism 250. Note that a heater (heater lamp) may be provided inside the pressure roller 220.

Since the fixing belt 211 is pressed against the pressure roller 220 by the nip forming member 212, the fixing belt 211 is driven to rotate by the rotation of the pressure roller 220.

The peeling member 270 is a peeling plate provided in the vicinity of the fixing belt 211 on the downstream side of the fixing nip region FN in the first rotation direction G1 of the fixing belt 211. This effectively prevents the recording medium P that has passed between the fixing belt 211 and the pressure roller 220 from being wound around the fixing belt 211.

Regarding Present Embodiment

First Embodiment

In the fixing device 200 (200A) according to the present embodiment, as shown in FIG. 9, the support member 215 includes a first support portion 2153 and a second support portion 2154. The first support portion 2153 supports the entire surface 212*a* of the nip forming member 212 opposite to the fixing belt 211 in the axial direction M and the short direction S. The second support portion 2154 is provided so as to stand from the surface 2153*a* of the first support portion 2153 opposite to the nip forming member 212 so that the center portion 2154*a* in the conveying direction F of the recording medium P is located on the downstream side of the center portion FNa of the fixing nip region FN in the conveying direction F and is located in the fixing nip region FN. The width of the fixing nip region FN in the conveying direction F is smaller than or equal to the width of the portion of the first support portion 2153 supporting the nip forming member 212 in the short direction S (conveying direction F).

The fixing device 200 (200A) according to the present embodiment uses the support member 215 including the first support portion 2153 and the second support portion 2154. As a result, the center portion 2154*a* of the second support portion 2154 in the conveying direction F of the recording medium P is located on the downstream side of the center portion FNa of the fixing nip region FN in the conveying direction F and is located in the fixing nip region FN, and the largest pressure is applied to the portion. Therefore, the portion of the fixing nip region FN to which the largest pressure is applied can be brought to the downstream end (the exit of the recording medium) or can be positioned at the downstream end (the exit of the recording medium). Accordingly, it is possible to reduce or eliminate a region where the pressure becomes smaller on the downstream side of the center portion FNa in the conveying direction F. Here, it is preferable that the center portion 2154*a* of the second support portion 2154 in the conveying direction F of the recording medium P is located closer to the downstream side than the center portion FNa of the fixing nip region FN in the conveying direction F of the recording medium P as long as the center portion 2154*a* is located within the fixing nip region FN. In particular, it is preferable that the center portion 2154*a* is located at the downstream end of the fixing nip region FN or in the vicinity of the downstream end of the fixing nip region FN in the fixing nip region FN. Therefore, when the recording medium P (the recording medium P on which the unfixed toner is placed) conveyed to the fixing device 200 (200A) is fixed in the fixing nip region FN and subsequently comes out of the fixing nip region FN, the recording medium P is less likely to be attracted toward the fixing belt 211 by the fixed toner because the pressure is highest at the downstream side of the center portion of the fixing nip region FN, and for example, the recording medium P can be easily separated from the fixing belt 211. Accordingly, it is possible to improve the peelability of the recording medium P from the fixing belt 211.

As described above, according to the present embodiment, it is possible to improve the peelability of the recording medium P from the fixing belt 211, and thereby it is possible to effectively prevent the occurrence of image defects such as image misregistration.

In the present embodiment, the second support portion 2154 is provided so as to stand from the surface 2153*a* of the first support portion 2153 on the side opposite to the nip forming member 212 along the pressure direction R to the fixing belt 211 by the pressure roller 220. In this way, the support strength of the first support portion 2153 for supporting the nip forming member 212 pressed by the pressure roller 220 can be improved by the second support portion 2154 standing from the first support portion 2153 along the pressure direction R, and thus the deflection of the nip forming member 212 pressed by the pressure roller 220 can be suppressed.

In the present embodiment, the thickness d2 of the second support portion 2154 is larger than the thickness d1 of the first support portion 2153. In this way, the supporting strength of the first support portion 2153 for supporting the nip forming member 212 pressed by the pressure roller 220 can be improved by the second support portion 2154 having the thickness d2 larger than the thickness d1 of the first support portion 2153, so that the deflection of the nip forming member 212 pressed by the pressure roller 220 can be suppressed.

In the present embodiment, the support member 215 includes the two support members 2151 and 2152. In this way, the supporting strength of the support member 215 for supporting the nip forming member 212 pressed by the pressure roller 220 can be improved by the two support members 2151 and 2152, so that the deflection of the nip forming member 212 pressed by the pressure roller 220 can be suppressed.

It is conceivable to increase the thickness of the second support portion 2154 from the viewpoint of improving the strength of the support member 215. However, since the thickness of the second support portion 2154 increases, the space in the fixing belt 211 is required, and it is impossible to secure a space for arranging the members to be provided in the fixing belt 211. Therefore, it is desired to secure a space for arranging the members to be provided in the fixing belt 211.

In this regard, in the present embodiment, each of the two support members 2151 and 2152 is formed in an L-shape in a cross-sectional view viewed from the axial direction M. Among the two support members 2151 and 152, a straight portion 2151*c* on one side of the L-shape of the support member 2151 faces a straight portion 2152*c* on one side of the L-shape of the other support member 2152 to form in a T shape in a cross-sectional view seen from the axial direction M. The first support portion 2153 has a configuration in which a straight portion 2151*d* on the other side of the L-shape of the support member 2151 and the straight portion 2152*d* on the other side of the L-shape of the other support member 2152 are connected in the straight direction. The second support portion 2154 has a configuration in which the straight portion 2151*c* on one side of the L-shape of the support member 2151 and the straight portion 2152*c* on one side of the L-shape of the other support member 2152 are connected in the thickness direction. Thus, it is possible to secure a space SP on the upstream side of the second support portion 2154 in the conveying direction F in the fixing belt 211. Accordingly, it is possible to secure a space for arranging the members to be provided in the fixing belt 211 on the upstream side of the second support portion 2154 in the conveying direction F in the fixing belt 211.

More specifically, the support members 2151 is a sheet metal member in which a plate-shaped member is bent in the pressure direction R from the end thereof on the conveying direction F side of the recording medium P. In this example, the thicknesses of the two support members 2151 and 2152 are the same as each other, and the thickness of each of the members 2151 and 2152 is about 1.6 mm. The other support member 2152 is a sheet metal member in which a plate-shaped member is bent in the pressure direction R from the end thereof positioned on the side on the opposite direction to the conveying direction F of the recording medium P. As a material that can be used for the sheet metal member, a metal material such as iron or stainless steel (SUS) can be used.

In the present embodiment, the fixing device 200 (200A) includes a heater 213 for heating the fixing belt 211 from inside.

When the heater 213 is provided on the downstream side of the fixing nip region FN in the rotational movement direction (first rotational direction G1) of the fixing belt 211, the distance that the fixing belt 211 circulates from the portion where the fixing belt 211 is heated by the heater 213 to the fixing nip region FN becomes long. As a result, the fixing belt 211 is likely to radiate heat, which prevents the recording medium P from being efficiently heated. Therefore, it is desired to heat the recording medium P efficiently.

In this regard, in the present embodiment, the heater 213 is provided on the upstream side of the second support portion 2154 in the conveying direction F. Thus, the heater 213 can be provided on the upstream side of the second support portion 2154 in the conveying direction F in the fixing belt 211. This makes it possible to shorten the distance that the fixing belt 211 circulates from the portion where the fixing belt 211 is heated by the heater 213 to the fixing nip region FN. Therefore, the fixing belt 211 is less likely to radiate heat, and thus the recording medium P can be efficiently heated. Further, the space SP on the upstream side of the second support portion 2154 in the conveying direction F in the fixing belt 211 can be effectively used.

The fixing belt 211 is biased in the axial direction M by the rotational movement, so that the end portion of the fixing belt 211 in the axial direction M is damaged or the inner circumference surface 211*a* of the fixing belt 211 is scraped off by the sliding of the fixing belt 211 with the nip forming member 212 by the pressure contact of the pressure roller 220. Accordingly, extraneous matter such as scraping of the fixing belt 211 may be generated. Therefore, it is desired to effectively prevent extraneous matter from coming into contact with the heater 213.

In this regard, in the fixing device 200 (200A) according to the present embodiment, a protection member 216 is provided between the heater 213 and the fixing belt 211. The protection member 216 allows the fixing belt 211 to be irradiated with the light emitted from the heater 213. This effectively prevents extraneous matter from coming into contact with the heater 213. Moreover, since the protection member 216 allows the fixing belt 211 to be irradiated with the light, it is possible to suppress a decrease in the heating efficiency to the fixing belt 211 by the heater 213.

Second Embodiment

Figure 10:
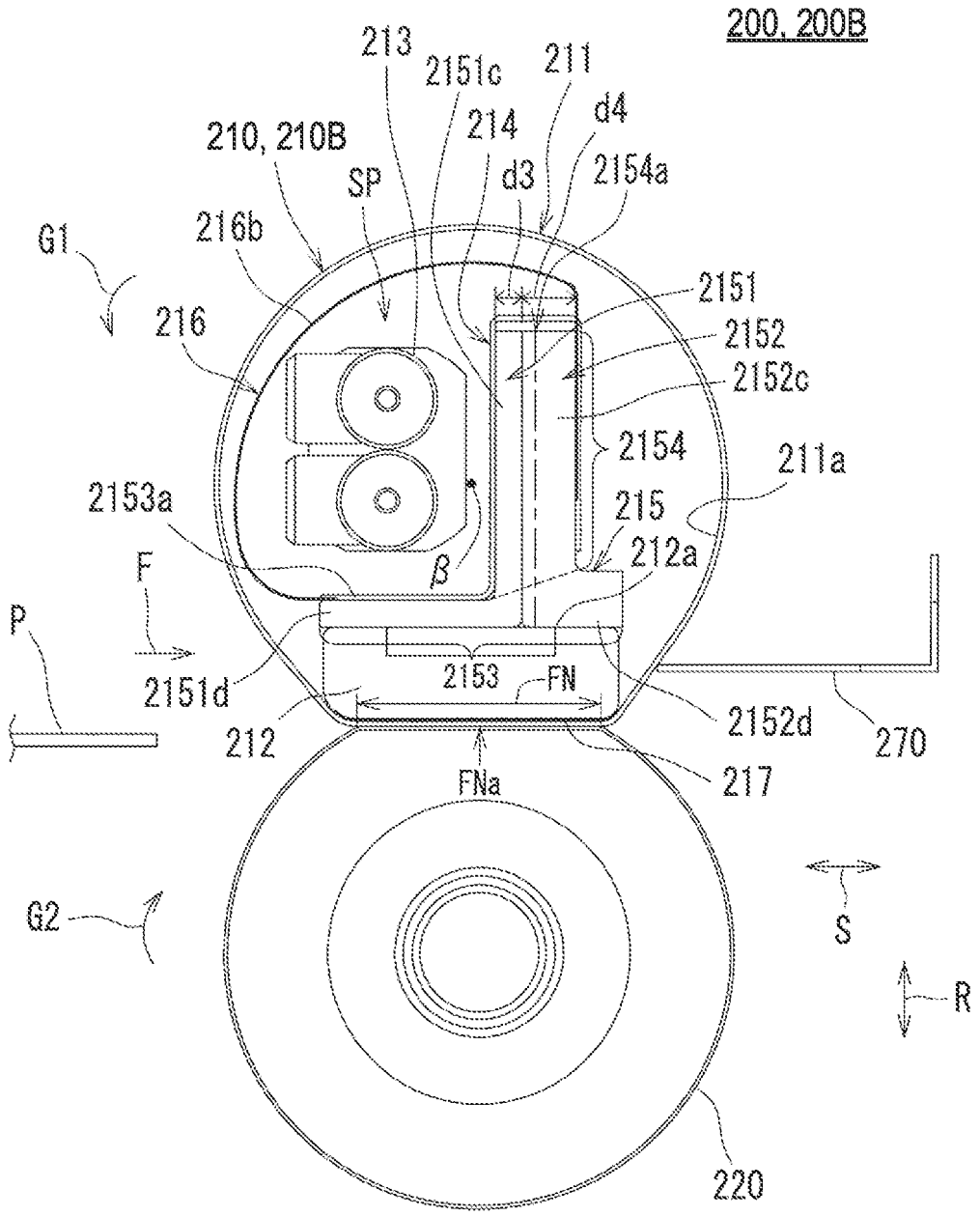
FIG. 10 is a cross-sectional view of a portion of a heat fixer and a pressure roller in a fixing device according to a second embodiment as viewed from the rear side.

FIG. 10 is a cross-sectional view of a portion of the heat fixer 210 (210B) and the pressure roller 220 in the fixing device 200 (200B) according to a second embodiment as viewed from the rear side.

The fixing device 200 (200B) according to the second embodiment is the same as the fixing device 200 (200A) according to the first embodiment except that the thickness d4 of the other support member 2152 is larger than the thickness d3 of the support member 2151.

In the present embodiment, the other support member 2152 is provided on the downstream side of the support member 2151 in the conveying direction F. The thickness d4 of the other support member 2152 is larger than the thickness d3 of the support member 2151. In this way, it is possible to improve the supporting strength of the other support member 2152 whose thickness d4 is larger than the thickness d3 of the support member 2151. Therefore, it is possible to suppress the bending of the nip forming member 212 pressed by the pressure roller 220.

Third Embodiment

Figure 11:
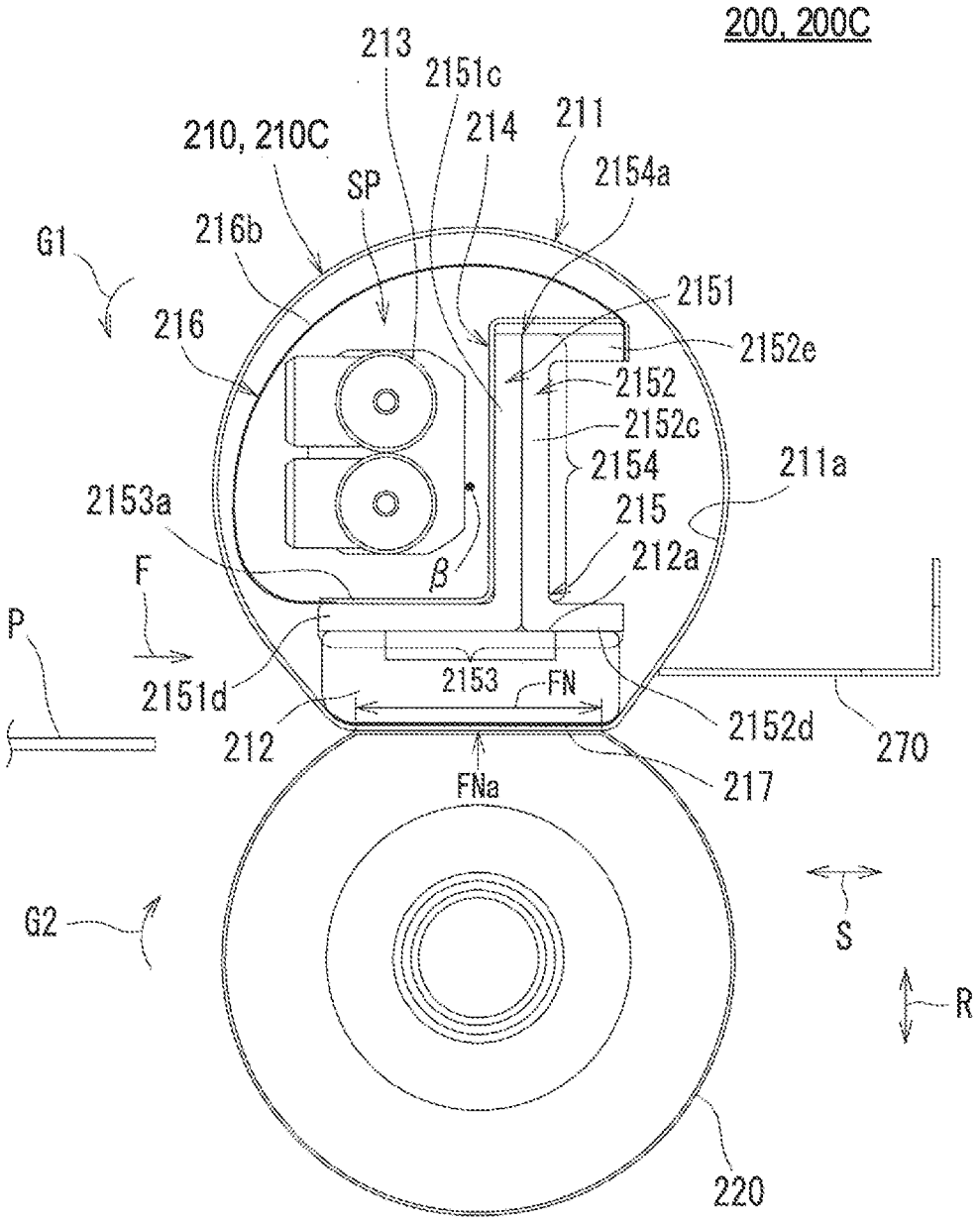
FIG. 11 is a cross-sectional view of a portion of a heat fixer and a pressure roller in a fixing device according to a third embodiment as viewed from the rear side.

FIG. 11 is a cross-sectional view of a portion of the heat fixer 210 (210C) and the pressure roller 220 in the fixing device 200 (200C) according to a third embodiment as viewed from the rear side.

The fixing device 200 (200C) according to the third embodiment is the same as the fixing device 200 (200A) according to the first embodiment except that the other support member 2152 has an extension portion 2152*e*.

In the present embodiment, the other support member 2152 is provided on the downstream side of the support member 2151 in the conveying direction F. The extension portion 2152*e* extending to the side opposite to the support member 2151 is provided at the end of the straight portion 2152*c* on one side of the L-shape of the other support member 2152 opposite to the straight portion 2152*d* on the other side. Thus, it is possible to improve the supporting strength of the other support member 2152 provided with the extension portion 2152*e*. Therefore, it is possible to suppress the bending of the nip forming member 212, which is pressed by the pressure roller 220.

Fourth Embodiment

Figure 12:
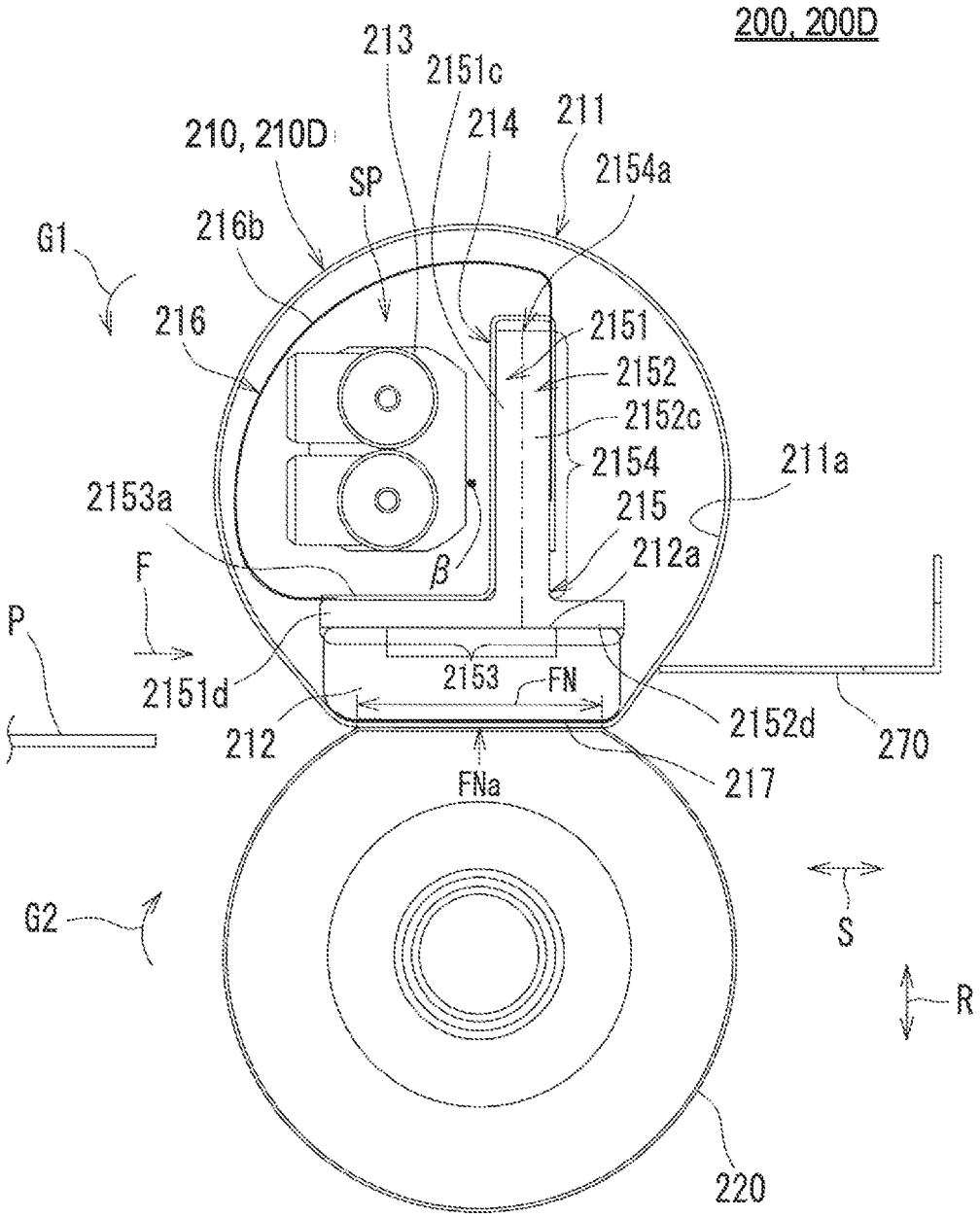
FIG. 12 is a cross-sectional view of a portion of a heat fixer and a pressure roller in a fixing device according to a fourth embodiment as viewed from the rear side.

FIG. 12 is a cross-sectional view of a portion of the heat fixer 210 (210D) and the pressure roller 220 in the fixing device 200 (200D) according to a fourth embodiment as viewed from the rear side.

The fixing device 200 (200D) according to the fourth embodiment is the same as the fixing device 200 (200A) according to the first embodiment except that the support member 2151 and the other support member 2152 are integrally formed in the support member 215.

In the present embodiment, the support member 2151 and the other support member 2152 of the support member 215 are integrally formed. In this way, the support strength of the support member 215 can be improved, and the deflection of the nip forming member 212 pressed by the pressure roller 220 can be suppressed. More specifically, the support member 215 can be formed by diecasting (mold casting method).

For example, the support member 215 may be formed by an aluminum die-cast which can be easily cast, although the followability for maintaining a predetermined temperature is deteriorated.

Fifth Embodiment

Figure 13:
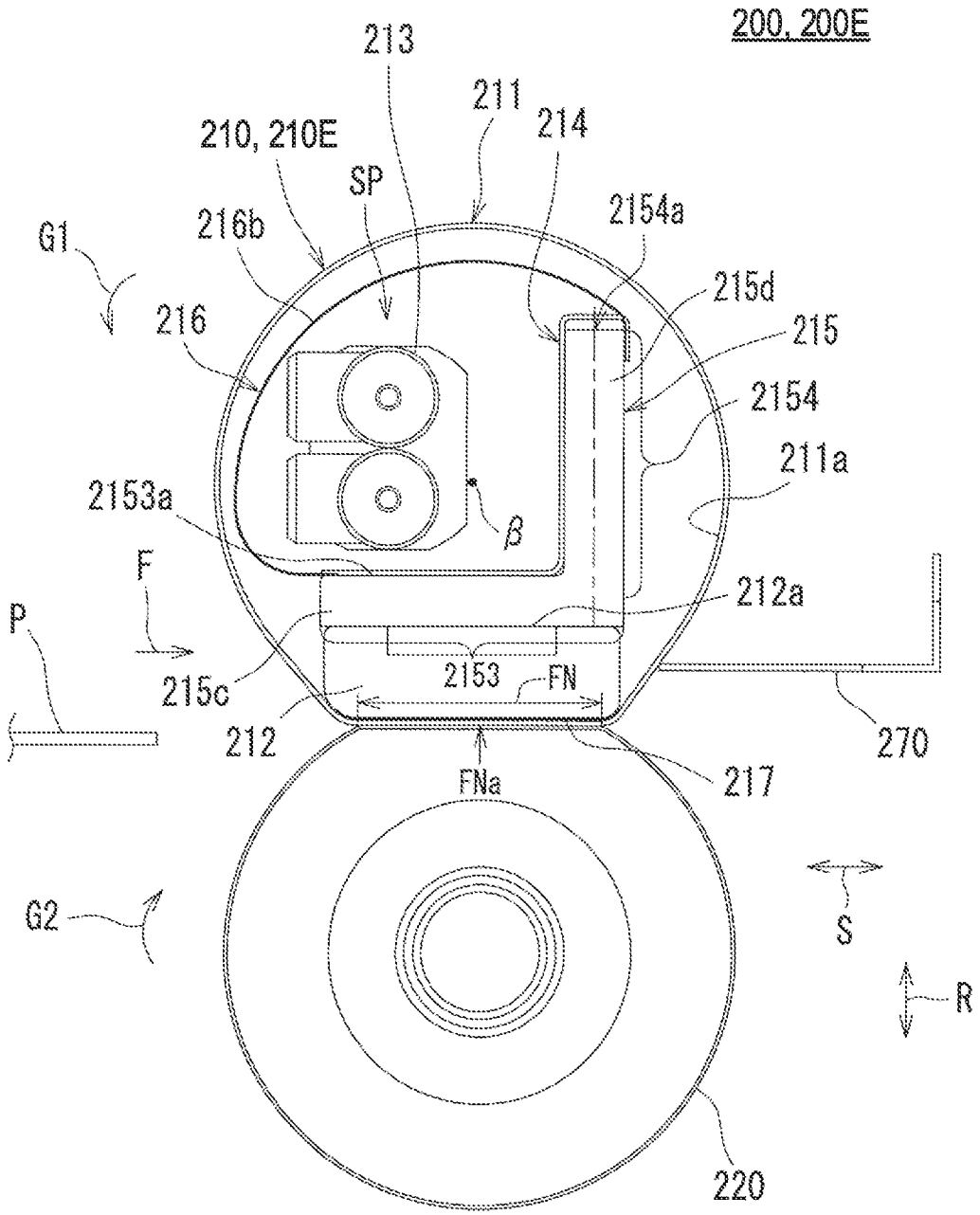
FIG. 13 is a cross-sectional view of a portion of a heat fixer and a pressure roller in a fixing device according to a fifth embodiment as viewed from the rear side.

FIG. 13 is a cross-sectional view of a portion of the heat fixer 210 (210E) and the pressure roller 220 in the fixing device 200 (200E) according to a fifth embodiment as viewed from the rear side.

The fixing device 200 (200E) according to the fifth embodiment is the same as the fixing device 200 (200D) according to the fourth embodiment except that the support member 215 is formed in an L-shape in a cross-sectional view viewed from the axial direction M.

In the present embodiment, the support member 215 is formed in an L shape in a cross-sectional view seen from the axial direction M. The first support portion 2153 is configured by a straight portion 215*c* on one side of the L-shape of the support member 215. The second support portion 2154 is configured by a straight portion 215*d* on the other side of the L-shape of the support member 215. Thus, it is possible to further secure the space SP on the upstream side of the second support portion 2154 in the conveying direction F in the fixing belt 211. Accordingly, it is possible to further secure a space for arranging the members to be provided in the fixing belt 211 on the upstream side of the second support portion 2154 in the conveying direction F in the fixing belt 211.

More specifically, the support members 2151 may be a sheet metal member in which a plate-shaped member is bent in the pressure direction R from the end thereof on the side of the conveying direction F of the recording medium P. As a material that can be used for the sheet metal member, a metal material such as iron or stainless steel (SUS) can be used.

Other Embodiments

In the first to fifth embodiments, the first support portion 2153 supports the entire surface 212*a* of the nip forming member 212 opposite to the fixing belt 211 in the short direction S. However, the first support portion 2153 may support a part thereof as long as the part includes a portion corresponding to the fixing nip region FN. Further, at least two of the configurations of the first to fifth embodiments may be combined.

The present invention is not limited to the embodiments described above, but may be implemented in various other forms. Therefore, such embodiments are merely examples in all respects and should not be construed as limiting. The scope of the present invention is indicated by the claims, and is not limited to the foregoing description. Further, all modifications and variations belonging to the equivalent scope of the claims are within the scope of the present invention.

What is claimed is:

1. A fixing device comprising:

an endless fixing belt capable of rotational movement;

a pressure member that presses from the outside of the fixing belt;

a nip forming member that is arranged on an inner circumference surface side of the fixing belt and forms a fixing nip region between the fixing belt and the pressure member; and a support member that supports the nip forming member from a side opposite to the fixing belt, wherein the support member comprises:

a first support portion that supports the nip forming member; and a second support portion that is provided so as to stand from a surface of the first support portion opposite to the nip forming member so that a center portion thereof in a conveying direction of a recording medium is located at a downstream side of a center portion of the fixing nip region in the conveying direction and is located in the fixing nip region, and wherein a thickness of the second support portion is greater than a thickness of the first support portion.

2. The fixing device according to claim 1, wherein the second support portion is provided so as to stand from the surface of the first support portion opposite to the nip forming member along a direction in which the pressure member presses the fixing belt.

3. A fixing device comprising:

an endless fixing belt capable of rotational movement;

a pressure member that presses from the outside of the fixing belt;

a nip forming member that is arranged on an inner circumference surface side of the fixing belt and forms a fixing nip region between the fixing belt and the pressure member; and a support member that supports the nip forming member from a side opposite to the fixing belt, wherein the support member comprises:

a first support portion that supports the nip forming member; and a second support portion that is provided so as to stand from a surface of the first support portion opposite to the nip forming member so that a center portion thereof in a conveying direction of a recording medium is located at a downstream side of a center portion of the fixing nip region in the conveying direction and is located in the fixing nip region wherein the support member is configured by two support members, wherein each of the two support members is formed in an L-shape in a cross-sectional view, and wherein the two support members are formed in a T-shape in a cross-sectional view by a straight portion on one side of the L-shape of one support member of the two support members and a straight portion on one side of the L-shape of the other support member facing each other.

4. The fixing device according to claim 3, wherein the first support portion is configured such that a straight portion on the other side of the L-shape of the one support member and a straight portion on the other side of the L-shape of the other support member are connected in a straight line direction, and wherein the second support portion is configured such that a straight portion on the one side of the L-shape of the one support member and a straight portion on the one side of the L-shape of the other support member are connected in a thickness direction.

5. The fixing device according to claim 4, further comprising;

a heater that heats the fixing belt from inside, wherein the heater is provided on an upstream side of the second support portion in the conveying direction.

6. The fixing device according to claim 5, wherein a protection member that protects the fixing belt from the heater is provided between the heater and the fixing belt.

7. The fixing device according to claim 3, wherein the other support member is provided on a downstream side of the one support member in the conveying direction, and a thickness of the other support member is larger than a thickness of the one support member.

8. The fixing device according to claim 3, wherein the other support member is provided on a downstream side of the one support member in the conveying direction, and wherein the other support member comprises an extension portion that extends on a side opposite to the one support member on an end portion of the straight portion on one side of the L-shape of the other support member opposite to the straight portion on the other side.

9. An image forming device comprising the fixing device according to claim 1.

10. The fixing device according to claim 3, wherein a thickness of the second support portion is greater than a thickness of the first support portion.

11. The fixing device according to claim 1, wherein the support member is configured by two support members.

12. An image forming device comprising the fixing device according to claim 3.

* * * * *